US007083547B2

(12) United States Patent
LaStayo et al.

(10) Patent No.: US 7,083,547 B2
(45) Date of Patent: Aug. 1, 2006

(54) METHOD AND APPARATUS FOR SPEED CONTROLLED ECCENTRIC EXERCISE TRAINING

(75) Inventors: Paul LaStayo, Salt Lake City, UT (US); Stan Lindstedt, Flagstaff, AZ (US); Hans Hoppeler, Bolligen (CH); Henry Madden, Boulder, CO (US); Daniel A. Estoque, Boulder, CO (US); William B. Stephens, Boulder, CO (US); Gregory D. Volan, Longmont, CO (US)

(73) Assignees: Arizona Board of Regents, Phoenix, AZ (US); Eccentron, LLC, Denver, CO (US)

( * ) Notice: Subject to any disclaimer, the term of this patent is extended or adjusted under 35 U.S.C. 154(b) by 91 days.

(21) Appl. No.: 10/650,455

(22) Filed: Aug. 27, 2003

(65) Prior Publication Data

US 2004/0082438 A1 Apr. 29, 2004

Related U.S. Application Data

(63) Continuation-in-part of application No. 10/203,909, filed on Oct. 29, 2002.

(60) Provisional application No. 60/185,623, filed on Feb. 29, 2000.

(51) Int. Cl.
*A63B 21/00* (2006.01)

(52) U.S. Cl. ..... 482/8; 482/9; 482/51; 482/900

(58) Field of Classification Search ..... 482/1–9, 482/900, 902, 51

See application file for complete search history.

(56) References Cited

U.S. PATENT DOCUMENTS

| | | | | |
|---|---|---|---|---|
| 4,601,467 | A | 7/1986 | Gvoich et al. | |
| 4,628,910 | A | 12/1986 | Krukowski | |
| 4,878,663 | A | 11/1989 | Luquette | |
| 5,011,142 | A | 4/1991 | Eckler | |
| 5,207,216 | A | 5/1993 | Sweeny | |
| 5,242,348 | A | 9/1993 | Bates | |
| 5,328,429 | A | 7/1994 | Potash et al. | |
| 5,374,193 | A | 12/1994 | Trachtman | |
| 5,476,428 | A | 12/1995 | Potash et al. | |
| 5,807,288 | A | 9/1998 | Wu | |
| 6,152,855 | A | 11/2000 | Dean, Jr. et al. | |
| 6,270,445 | B1 * | 8/2001 | Dean et al. | 482/4 |
| 6,367,352 | B1 | 4/2002 | Niculescu | |
| 6,456,885 | B1 | 9/2002 | Shiba et al. | |

OTHER PUBLICATIONS

Jan Friden, Changes in human skeletal muscle induced by long-term eccentric exericse, Cell and Tissue Research (1984) 236:365-372.

(Continued)

*Primary Examiner*—Glenn E. Richman
(74) *Attorney, Agent, or Firm*—Snell & Wilmer L.L.P.

(57) ABSTRACT

A method and apparatus for providing speed controlled eccentric exercise which include an exercise apparatus having an engagement member for engaging a user's body where the engagement member is moveable in opposite directions, means for enabling the engagement member to exert a force in a first direction at a predetermined speed, means for detecting change in the predetermined speed or pressure of the force after a user applies a force to the engagement means in a direction opposite the first force, and means for adjusting the apparatus supplied force and user supplied forces to equal one another or to maintain the predetermined speed.

17 Claims, 18 Drawing Sheets

OTHER PUBLICATIONS

B.C. Abbott and Brenda Bigland, The Effects of Force and Speed Changes on the Rate of Oxygen Consumption During Negative Work, J. Physiol. (1953) 120, 319-325.

Paavo V. Komi and Jukka T. Viitasalo, Changes in Motor Unit Activity and Metabolism in Human Skeletal Muscle during and after Repeated Eccentric and Concentric Contractions, Acta physiol. scand. 1977. 100. 246-254.

K. Klausen and H. G. Knuttgen, Effect of Training on Oxygen Consumption in Negative Muscular Work, Acta physiol. scand. 1971. 83. 319-323.

J. M. Rooyackers, P. N. R. Dekhuijzen, C. L. A. Van Herwaarden and H. T. M. Folgering, Ventilatory response to positive and negative work in patients with chronic obstructive pulmonary disease, Respiratory Medicine (1997) 91. 143-149.

* cited by examiner

METHOD AND APPARATUS FOR SPEED CONTROLLED ECCENTRIC EXERCISE TRAINING

CROSS-REFERENCES TO RELATED APPLICATIONS

This application is a continuation-in-part application of U.S. application Ser. No. 10/203,909 filed Oct. 29, 2002 which claims the benefit of U.S. Provisional Application No. 60/185,623, filed Feb. 29, 2000, which is incorporated herein by reference.

Financial assistance for this project was provided by the U.S. Government through the National Science Foundation under Grant Number IBN9714731; and the United States Government may own certain rights to this invention.

FIELD OF THE INVENTION

The present invention relates, generally, to a method and apparatus for increasing muscle size and strength, as well as lung capacity, at low training intensities by utilizing eccentric ergometry and, more particularly, to a method and apparatus for providing speed controlled eccentric exercise.

BACKGROUND OF THE INVENTION

It is commonly accepted that at least minimal physical activity is necessary to maintain muscle mass. If such minimal activity is lacking, the muscular system becomes atrophied and muscle mass diminishes. Muscular activity is energetically consuming, i.e. oxygen consumption by the muscular system increases heavily during physical activity. For example, oxygen consumption for a healthy person at rest may increase 10–15 times with physical activity. If an adequate amount of oxygen fails to reach the muscle, physical activity will be limited. Inadequate oxygen delivery may be due to a disorder in oxygen reception in the lungs or to insufficient transport of the oxygen to the muscles. Insufficient pumping of the heart is designated heart insufficiency. Muscle reduction begins in those with heart disease as a result of insufficient activation of the heart muscles. This in turn leads to a further reduction of the pumping performance of the heart thereby resulting in circulus vitiosus. The present invention can be used to interrupt this process or condition.

Stength gains occur when muscle produces force. If the muscle shortens while producing force, it produces concentric (Con) positive work. If it lengthens while producing force, work is done on the muscle resulting in eccentric (Ecc) negative work. A muscle action is designated "concentric" if the force of a muscle overcomes an applied resistance and a muscle action is designated "eccentric" if the muscle force is less than the applied resistance. "Acceleration work" results from concentric contractions and "deceleration work" results from eccentric contractions. For example, one may imagine that ascending a mountain requires exclusively concentric work and that descending the same mountain requires mostly only eccentric work. From a physical point of view, equal energy is converted in both cases. In ascending, potential energy is gained while in descending, the same amount of energy is lost. Although physically the same energy amounts are converted, the amount of energy to be spent by the muscular system for ascending is much higher than the amount of energy lost in descending. Five to seven times more energy is spent for concentric work as is spent for physically equal eccentric work.

The magnitude of strength gains seems to be a function of the magnitude of the force produced regardless of its Ecc or Con work. Ecc training has the capability of "overloading" the muscle to a greater extent than Con training because much greater force can be produced eccentrically than concentrically. Accordingly, Ecc training can result in greater increases in strength.

Furthermore, the Ecc mode of contraction has another unique attribute. The metabolic cost required to produce force is greatly reduced; muscles contracting eccentrically get "more for less" as they attain high muscle tensions at low metabolic costs. In other words, Ecc contractions cannot only produce the highest forces in muscle vs. Con or isometric contractions, but do so at a greatly reduced oxygen requirement ($Vo_2$). This observation has been well-documented since the pioneering work of Bigland-Ritchie and Woods (*Integrated eletromyogram and oxygen uptake during positive and negative work*, Journal of Physiology (Lond) 260:267–277, 1976) who reported that the oxygen requirement of submaximal Ecc cycling is only 1/6–1/7 of that for Con cycling at the same workload Typically, single bouts of Ecc exercise at high work rates (200–250 W for 30–45 minutes) result in muscle soreness, weakness, and damage in untrained subjects. Therefore, the common perception remains that Ecc muscle contractions necessarily cause muscle pain and injury. Perhaps because of this established association between Ecc contractions and muscle injury, few studies have examined prolonged exposure to Ecc training and its effect on muscle injury and strength. Nonetheless, Ecc contractions abound in normal activities such as walking, jogging, descending/walking down any incline, or lowering oneself into a chair to name just a few. Obviously, these activities occur in the absence of any muscular damage or injury.

Accordingly, there is a need for providing chronic Ecc training techniques and/or apparatus that can improve locomotor muscle strength without causing muscle injury.

SUMMARY OF THE INVENTION

Because muscles contracting eccentrically produce higher force, and require less energy to do so, Ecc training possesses unique features for producing both beneficial functional (strength increases) and structural (muscle fiber size increases) changes in muscles, and especially in locomotor muscles. For example, because Ecc work can overload muscle at $Vo_2$ levels that have little or no impact on muscle when the work is performed concentrically, then strength and muscle size increases might be possible in patients who heretofore have difficulty maintaining muscle mass due to severe cardiac and respiratory limitations. Ecc training may also increase the strength and size of other muscles in addition to locomotor muscles and may also be used to increase lung capacity.

The present invention is directed to an apparatus for performing speed controlled eccentric exercise which includes a frame, at least one support attached to the frame for supporting a user's body, at least one engagement member for engaging a part of the user's body where the engagement member is attached to the frame and moveable in opposite directions, means for supplying power to the engagement so the engagement member can exert a force in a first direction at a predetermined speed, means for detecting any change in the predetermined speed after the user supplies force to the engagement member in a direction opposite the first direction, and means for adjusting the output from the power supply to maintain the original predetermined speed.

In one aspect of the invention, the support may be a seat which in turn may be a seat that is recumbent and/or adjustable. The apparatus may also include a support structure for the seat which is positioned between the seat and the frame.

In another aspect of the invention, the engagement member may comprise a bar press or a turn crank, either of which may further include a pedal Or a hand grip. In addition, a drive mechanism, powered by the power supply, may be attached to the engagement member to move the engagement member. If the engagement member is a turn crank, the drive mechanism may move the turn crank in a counterclockwise direction. Alternatively, if the engagement member is a bar press, the drive mechanism may move the bar press in alternating forward and backward directions.

In yet another aspect of the invention, the apparatus may include a safety element which prevents a user's joints from fully extending and locking while operating the apparatus. The apparatus may also include a control panel for operating the apparatus and a display means for displaying pertinent data. Moreover, the apparatus of the present invention can be used to perform a variety of eccentric exercises including lower body eccentric exercise where the engagement member(s) engage a user's feet or legs and upper body eccentric exercise where the engagement member(s) engage a user's hands or arms.

The present invention is also directed to a method for providing speed controlled eccentric exercise which includes the steps of providing an exercise apparatus capable of applying a force against a user in a first direction at a predetermined speed, allowing the user to resist the force in the first direction by applying a force in an opposite direction, monitoring the user applied force, and controlling the apparatus applied force in response to the user's applied force to maintain the predetermined speed of the apparatus.

In one aspect of the inventive method, the step of controlling the apparatus applied force may include the step of adjusting the apparatus applied force to equal the user applied force.

In another aspect of the invention, the inventive method may further include the step of displaying pertinent data relating to the eccentric exercise such as, for example, deceleration power, time elapsed, a user's heart rate, and a number of revolutions or reciprocations per minute.

In still another aspect of the method of the present invention, the step of providing an apparatus may include the step of providing a recumbent exercise bicycle capable of applying a force against a user in a first direction by providing a torque in a counterclockwise direction or the step of providing an apparatus having reciprocating bar presses.

BRIEF DESCRIPTION OF THE DRAWING FIGURES

The present invention will hereinafter be described in conjunction with the appended drawing figures, wherein like numerals denote like elements, and:

DETAILED DESCRIPTION OF EXEMPLARY EMBODIMENTS

Figure 1:
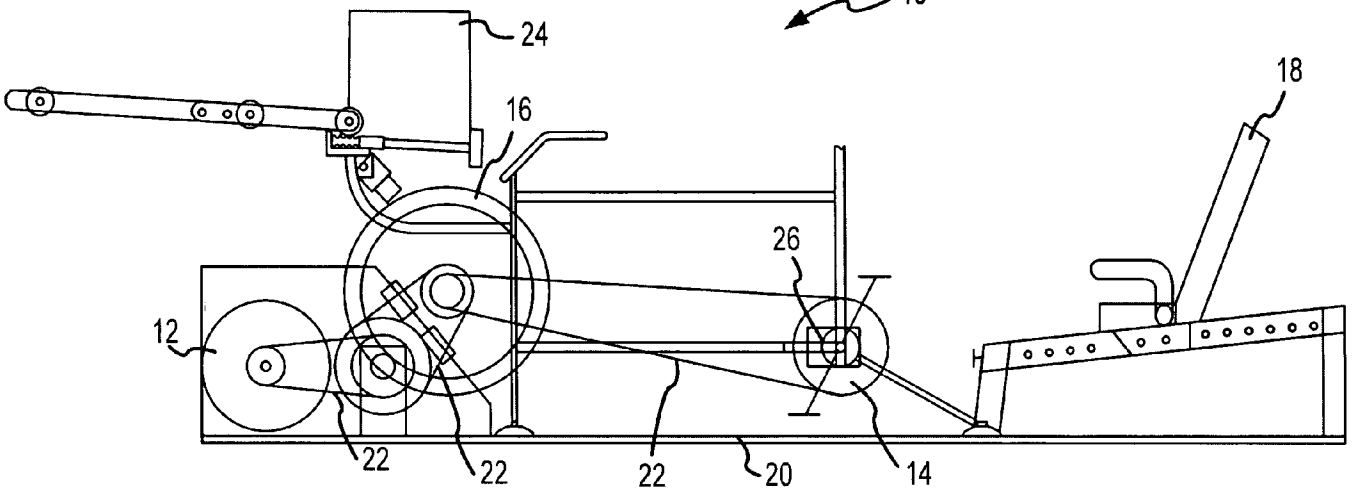
FIG. 1 is a side elevational and partial cross-sectional view of an eccentric ergometer in accordance with the present invention.

The present invention is directed to a method and apparatus for increasing muscle size and strength, as well as lung capacity, at low training intensities utilizing eccentric ergometry. The apparatus of the present invention comprises means for applying a torque transfer to the human muscular system. The apparatus is directed to an eccentric ergometer device 10, shown in FIGS. 1–2 , which includes a motor 12, a turning or pedal crank 14, at least one flywheel 16, and an adjustable seat 18. The motor 12, turning crank 14, and seat 18 are all coupled to a frame 20 which is preferably comprised of steel, or a similar type of strong, durable material. The motor 12 is mechanically coupled to the turning crank 14 by one or more chains 22 which may also take the form of toothed belts or cardan shafts. The device 10 further comprises display means 24, such as a monitor, for displaying deceleration power data produced by a user's muscular system in resisting torque transfer as well as other data including, but not limited to, time elapsed, heart rate, pedal revolutions per minute, intensity level, speed, and measurement of work performed. A magnetic sensor 26 monitors pedal speed.

In constructing the embodiment of the eccentric ergometer of the present invention which is depicted as device 10, the power train of a standard Monarch cycle ergometer may be used. The adjustable seat 18 may comprise a recumbent seat and the device 10 may be driven, for example, by a three-horsepower direct current (DC) motor with one or more idlers between the motor 12 and the flywheel 16. The gear ratio from the flywheel 16 to the turning or pedal crank 14 is preferably about 1:3.75. As previously stated, all components are mounted to a steel frame 20 for stability. A motor controller 28 controls the motor speed and preferably has a 0 to 10 Volt output for both motor speed and load. The magnetic sensor 26 monitors pedal revolutions per minute (rpm) which is preferably displayed to the rider/user during the training session The voltage and amperage outputs from the controller 28 are monitored through an analog-to-digital board and dedicated computer. The motor 12 also includes an on/off switch 30 which is accessible by a user in order to switch the device on and off from the position of use. A safety shut off may also be included which may be programmed to automatically shut off the motor once certain predetermined parameters are reached.

In using ergometer device 10, a desired speed is input by a user or computer program so that turning or pedal crank 14 rotates in a counterclockwise direction at the desired speed A user then resists the rotation of turning or pedal crank 14, or in other words attempts to accelerate the device by pedaling in a clockwise direction, and any change in the speed of rotation is sensed and then compensated for by motor controller 28 and motor 12 so that the desired speed, i.e. preset velocity, can be maintained. The ergometer device of the present invention is a speed controlled device which controls and maintains a preset speed by varying the torque of the device in response to the magnitude of torque applied by a user.

The ergometer device 10 can be calibrated by using the original standard ergometers friction band and applying known loads (via weights) as the motor 12 moves the flywheel 16 in a forward direction at a fixed rpm and reading the amperage/voltage of the motor. Therefore, for a fixed load and rpm, the calibration performed in the forward direction also serves to calibrate the reverse direction of the flywheel depending upon the wear that may have occurred in a particular direction.

For purposes of the present invention, the eccentric ergometer device is defined as a powered, recumbent device that is used in the active mode to enable a user to experience eccentric loads. The device may be used to impart an eccentric load on a muscle to increase muscle size and strength, and to increase lung capacity. The active recumbent device includes means for continuously applying a torque through three hundred sixty degrees of rotation for extended periods of time.

Figure 2:
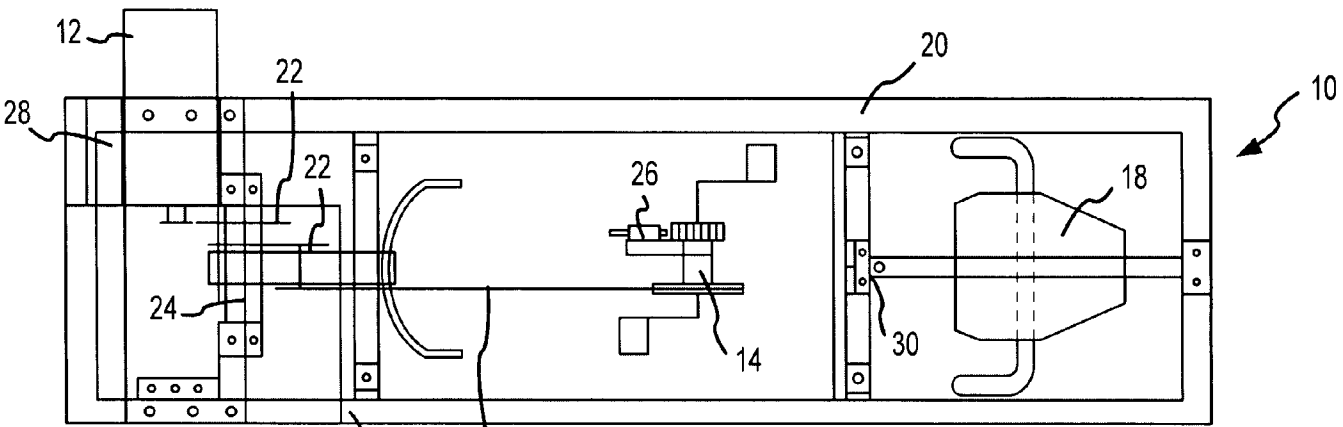
FIG. 2 is a top elevational view of the eccentric ergometer shown in FIG. 1 in accordance with the present invention.
Figure 3:
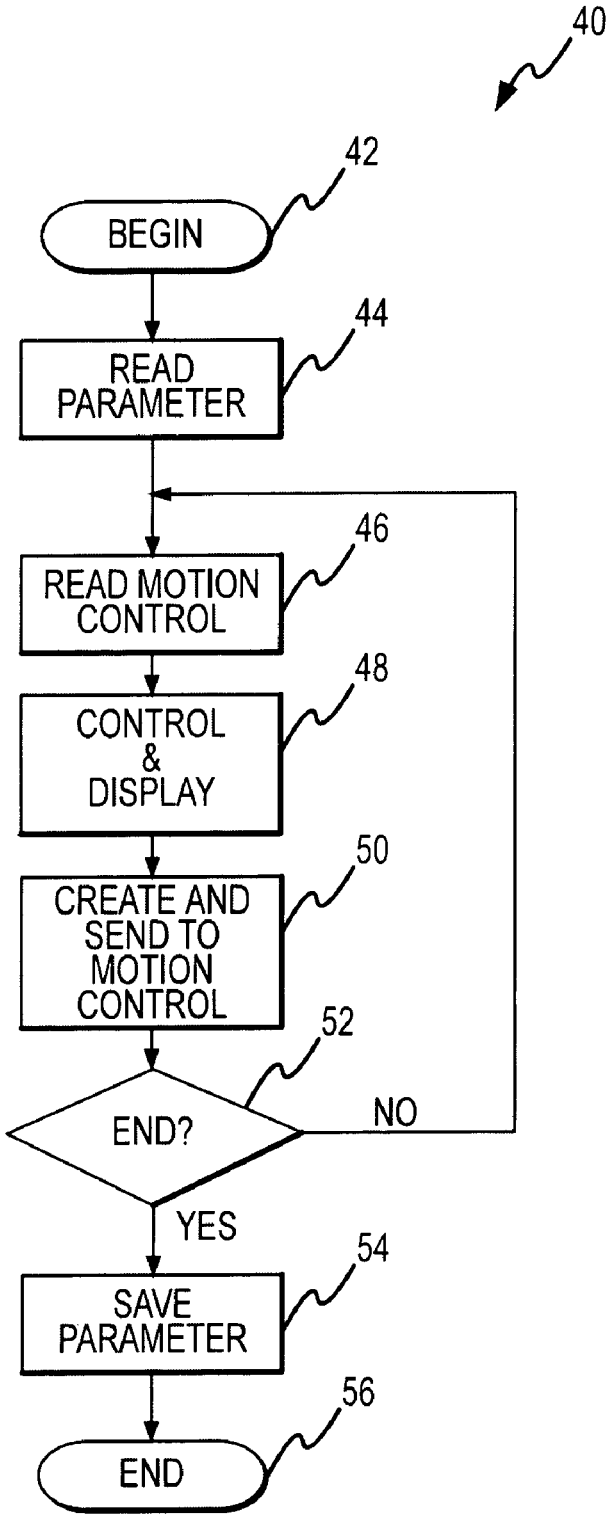
FIGS. 3–4 are flowcharts showing a method for torque-controlled eccentric exercise training using the eccentric ergometer shown in FIGS. 1–2.
Figure 4:
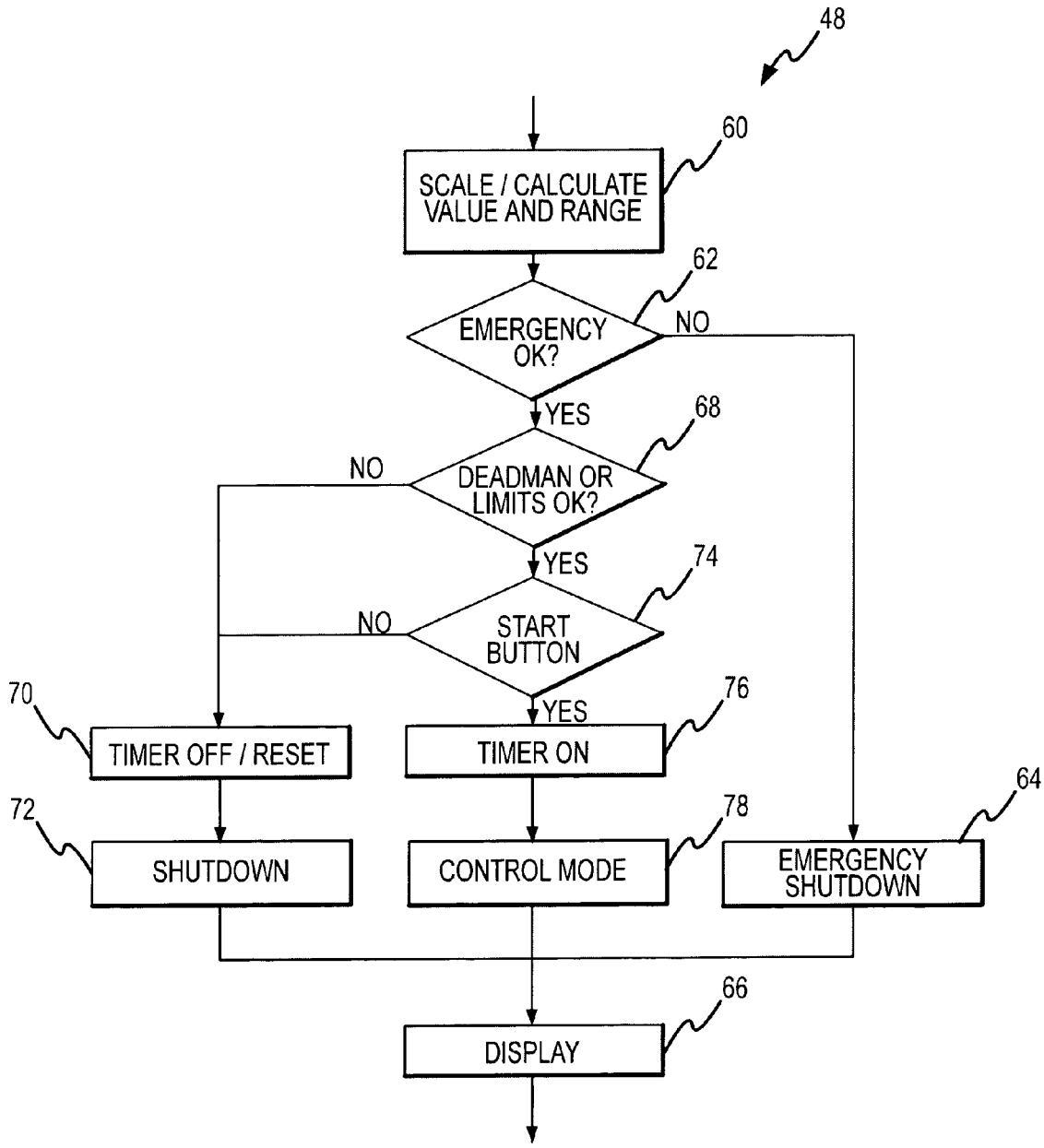

FIGS. 3–4 are flowcharts showing a method for speed-controlled exercise training 40 using the eccentric ergometer device 10 shown in FIGS. 1–2 . The method 40 is preferably carried out by a software program that controls the functioning of the eccentric ergometric device 10. The method starts by beginning a training session in step 42 and one or more first parameters are read in step 44. The motion control of the device 10 is read in step 46 and a user may then control and display specific parameters for the functioning of the device 10 in step 48. Once the desired controls are displayed in step 48, the program recipe is created and sent to the motion control for the device in step 50. Once the user has trained or practiced at the desired setting for a desired time period (programmed recipe), the user determines whether or not to end the training session in step 52. If the user elects to end the previously programmed training session, the user may then return to step 46 to read the motion control and continue on through steps 48–50 to train on another set of preprogrammed parameters. Alternatively, if the user elects to end the training session in step 52, the parameters of the training session can be saved in step 54 and the training session then ends in step 56.

Turning now to FIG. 4, there is shown a flowchart which depicts a more detailed procedure for the control and display step 48 in FIG. 3. The first step in controlling and displaying parameters for a training session involves calculating the values and ranges of parameters in step 60 that are required to achieve certain desired outcomes. In step 62, a determination is made as to whether or not an emergency shut off is appropriate. If so, an emergency shutdown takes place in step 64 which is then reflected by displaying the same in display step 66. If there is no emergency in step 62, a determination is made in step 68 as to whether the limits set for the training program are acceptable. If the limits are not acceptable, the timer is shut off and reset in step 70 and the training session is shutdown in step 72. This shutdown in step 72 is then displayed in display step 66. If the limits set for the training session are acceptable, a user determines whether or not to press the start button in step 74. If the start button is not pressed in step 74, the timer is shut off and reset in step 70 and the training session is shutdown in step 72. Again, this shutdown in step 72 is displayed in display step 66. Alternatively, if the user elects to press the start button in step 74, the timer is turned on in step 76 and the training session enters the control mode in step 78. The control mode is then displayed in display step 66.

Examples of Training Regimens Used With The Embodiment Of The Eccentric Ergometer Device of the Present Invention Shown in FIGS. 1–2

Six Week Training Regimen:

Subjects and training regimen: Nine healthy subjects 18–34 (mean 21.5) years old were assigned at random to one of two exercise training groups: 1) an Ecc cycle ergometer like that shown in FIGS. 1–2 , two males (1 sedentary, 1 regular moderate exerciser) and two females (1 regular moderate exerciser, 1 competitive triathlete), or 2) traditional Con ergometer, two irregularly exercising males and three light exercising females. Both the Ecc and Con groups trained for six weeks with a progressively increasing frequency and duration of training (and a pedal rpm of 50–60). During the first week, each group trained two times for 10–20 minutes. Both groups then exercised three times during the second week for 30 minutes and finally five times per week for 30 minutes during the third-sixth weeks. During the first four weeks, the Ecc group began with threefold greater work rates than the Con group. During the fifth week, work rates were adjusted in an attempt to equalize $Vo_2$ between the groups.

Measurements: To assess skeletal muscle strength changes, maximal voluntary isometric strength produced by the knee extensors was measured with a Cybex dynamometer before, after and during training. $Vo_2$ was measured once a week while training with an open spirometric system with subjects wearing a loose fitting mask. A visual analog scale (VAS) was used to determine the perception of lower extremity muscle soreness. Subjects were asked to report a rating of perceived exertion (RPE) on a scale rating.

Figure 6:
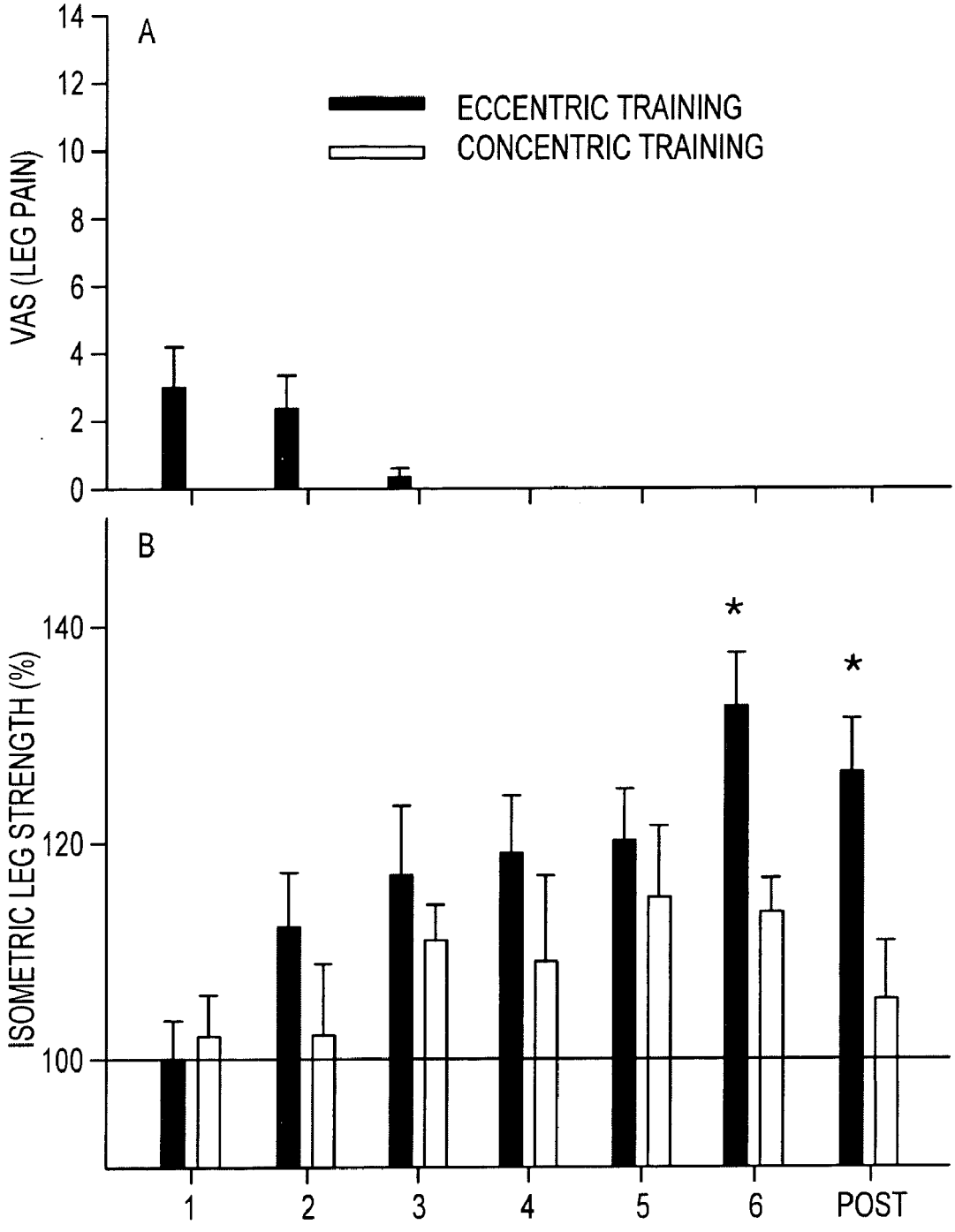
FIG. 6 is a bar graph comparing leg pain and isometric leg strength measurements both during and after a six week training regimen using a traditional concentric ergometer and the eccentric ergometer shown in FIGS. 1–2.

The results of the study demonstrated that if the Ecc work rate is ramped up during the first four weeks and then maintained for at least two weeks, strength gains can be made with minimal muscle soreness and without muscle injury as noted by the VAS and no loss in leg strength at any time during the study. In fact, leg strength increased significantly in the Ecc group. (See FIG. 6). Progressive ramping of the Ecc work prevented nearly all of the typical or expected muscle injury and eliminated all muscle soreness associated with the first few weeks of Ecc training. Despite efforts to equalize the exercising $Vo_2$ by altering work rates, Ecc was less than Con throughout the fifth week of training and not equalized until the sixth week gains in leg strength were noted with the Ecc training group whereas no strength changes occurred with the Con group.

Figure 5:
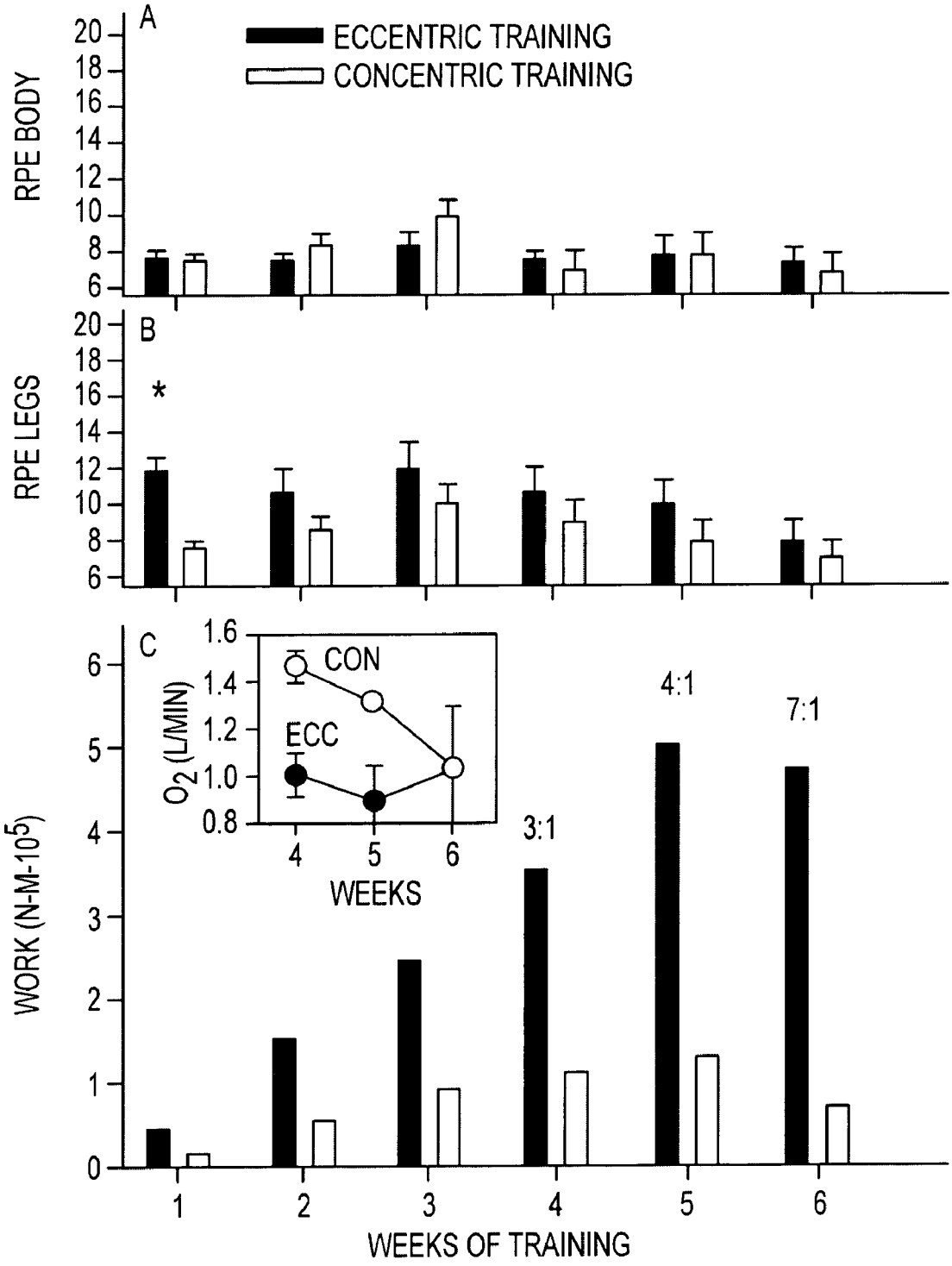
FIG. 5 is a bar graph comparing whole body and leg exertion measures and total work and oxygen costs during a six week training regimen using a traditional concentric ergometer and the eccentric ergometer shown in FIGS. 1–2.

With respect to FIG. 5, the only significant differences noted in perceived body and leg exertion were in the RPE (legs) during the first week of training when the Ecc group had a greater perceived leg exertion.

The strength enhancements using the method and apparatus of the present invention, with very minimal cardiac demand, may have profound clinical applications. Despite improvements in strength and muscle mass with high-intensity resistance training in healthy elderly, many with cardiovascular disease cannot exercise at intensities sufficient to improve skeletal muscle mass and function. Exercise intensity in this population is often severely limited by the inability of the cardiovascular system to deliver adequate oxygen to fuel muscles at levels significantly above resting. For many elderly patients, the symptom inducing metabolic limits have been estimated as low as 3 METS which is equivalent to con cycling at approximately 50 W on an ergometer. Such work rates may be insufficient to adequately stress muscle and prevent muscle atrophy and the concomitant functional decline. This group of patients with chronic heart failure and/or obstructive pulmonary disease could maintain their muscle mass and potentially even experience an increase in muscle strength during their exercise rehabilitation by using the method and apparatus of the present invention.

Eight Week Training Regimen:

Subjects and training regimen: Fourteen healthy male subjects with a mean age of 23.9 years (range, 19–38 years) were systematically grouped to create two groups of seven subjects, each with an equivalent mean peak oxygen consumption ($Vo_{2peak}$) the two groups were assigned at random to one of the following two groups: 1) an Ecc cycle ergometer like that shown in FIGS. 1–2 or 2) a traditional Con cycle ergometer. After two weeks of training, one subject in the Con group dropped out leaving n=7 for the Ecc group and n=6 for the Con group.

Figure 7:
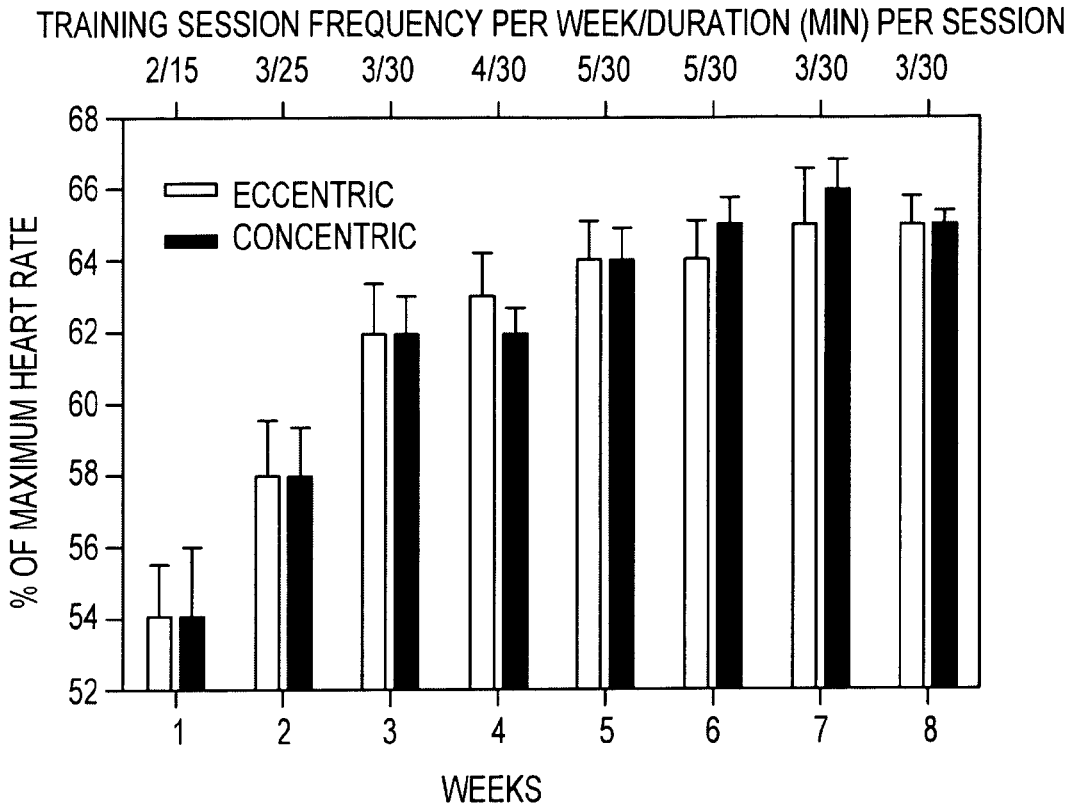
FIG. 7 is a bar graph comparing eccentric and concentric training intensities measured by maximum heart rate during an eight week training period using a traditional concentric ergometer and the eccentric ergometer shown in FIGS. 1–2.

Each subject performed a $Vo_{2peak}$ test on a traditional Con ergometer and the subject" peak heart rate ($HR_{peak}$) was defines as the heart rate obtained at $Vo_{2peak}$. Training exercise intensity was set to a fixed and identical percentage of $HR_{peak}$ (% $HR_{peak}$) in both groups of subjects and heart rate was monitored over every training session for the 8 weeks of training. % $HR_{peak}$ was progressively ramped for both groups in an identical fashion during the training period, from an initial 54% to a final 65% $HR_{peak}$. (See FIG. 7). The training period extended for eight weeks with a progressively increasing frequency and duration of training. During week 1, all subjects rode 2 times/wk for 15 minutes. Training frequency was 3 times per week for weeks 2 and 3 at 25–30 minutes, 4 times/week at 30 minutes for week 4, and 5 times/week for 30 minutes during weeks 5 and 6. The frequency of training was decreased to 3 times/week, but training duration remained at 30 minutes for weeks 7 and 8 due to the Ecc subjects subjective feeling of "fatigue". Pedal rpm was identical for both groups (started at 50 rpm and progressively increased to 70 rpm by the fifth week).

Measurements: All measurements were the same as the six week training regimen discussed above in addition to the following: Total work (joules) on the Ecc ergometer per training session was calculated by integrating the work rate (watts), determined directly from a 0 to 10 volt output from the motor, which was calibrated to a known work rate, over the total duration of each training session. The total work per training session was calculated on the Con recumbent ergometer by multiplying the work rate displayed on the calibrated ergometer by the duration of each training session. A single needle biopsy from the vastus lateralis at the midthigh level was taken 2 days before the beginning of the study and 1–2 days after the eight week study ended to measure muscle fiber ultrastructure and fiber area. The capillary-to-fiber ratio was determined by counting the number of capillaries and fibers via capillary and fiber profiles from electron micrographs.

Figure 8:
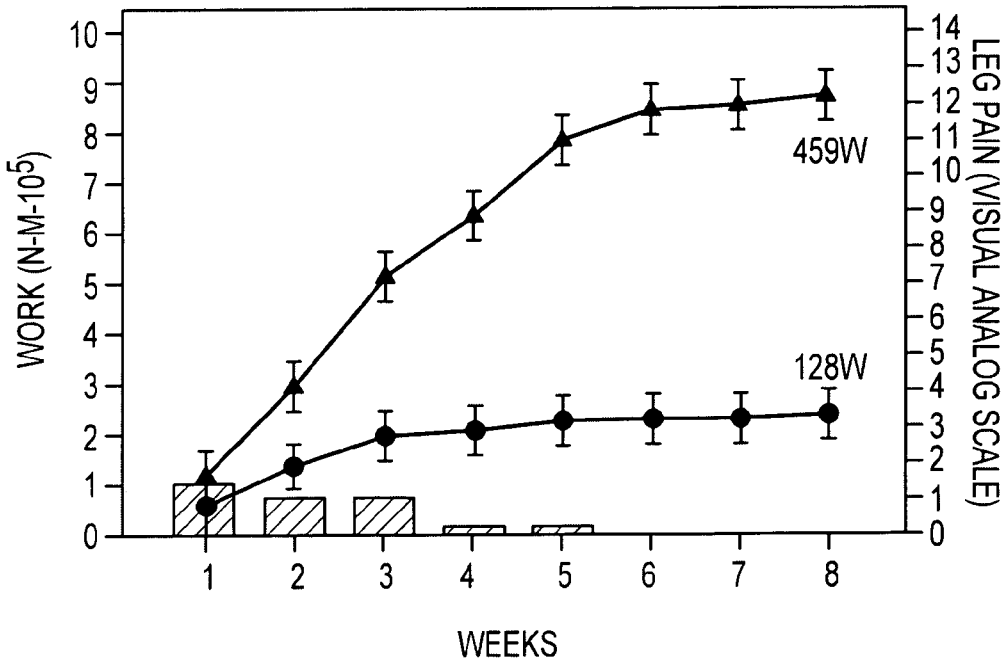
FIG. 8 is a graph comparing the amount of eccentric and concentric work performed during an eight week training period using a traditional concentric ergometer and the eccentric ergometer shown in FIGS. 1–2.
Figure 9:
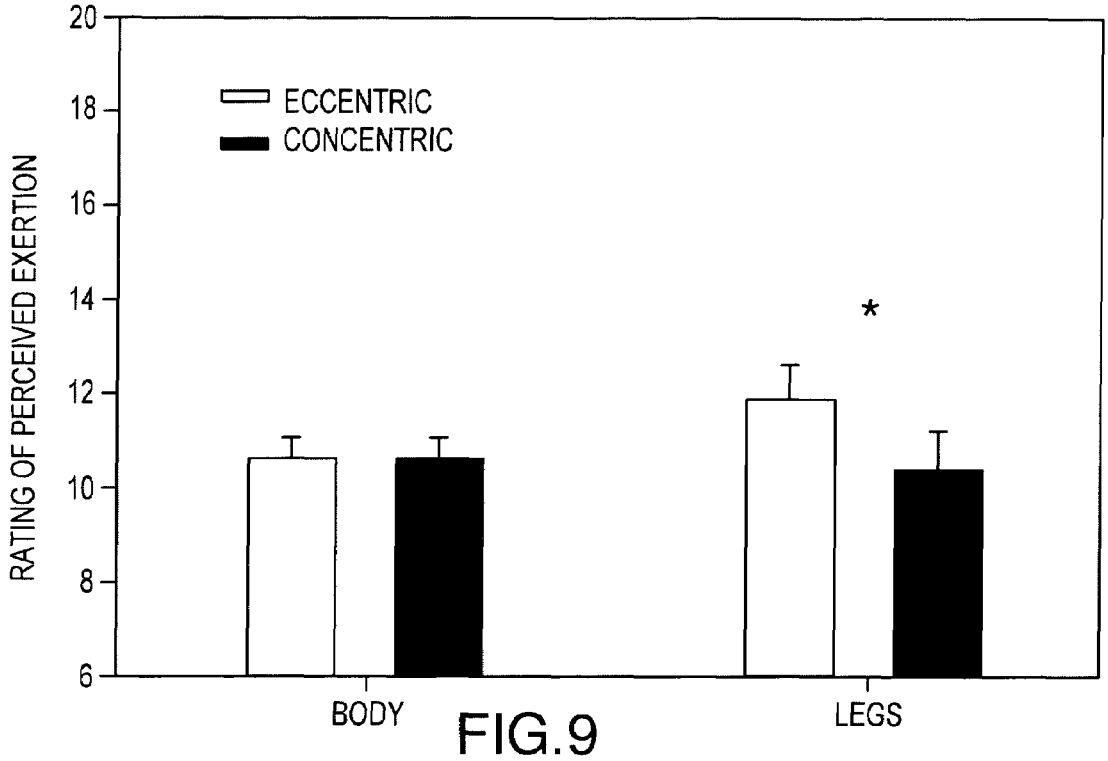
FIG. 9 is a bar graph comparing the rating of perceived exertion for the body and legs using the Borg scale during an eight week training period using a traditional concentric ergometer and the eccentric ergometer shown in FIGS. 1–2.
Figure 10:
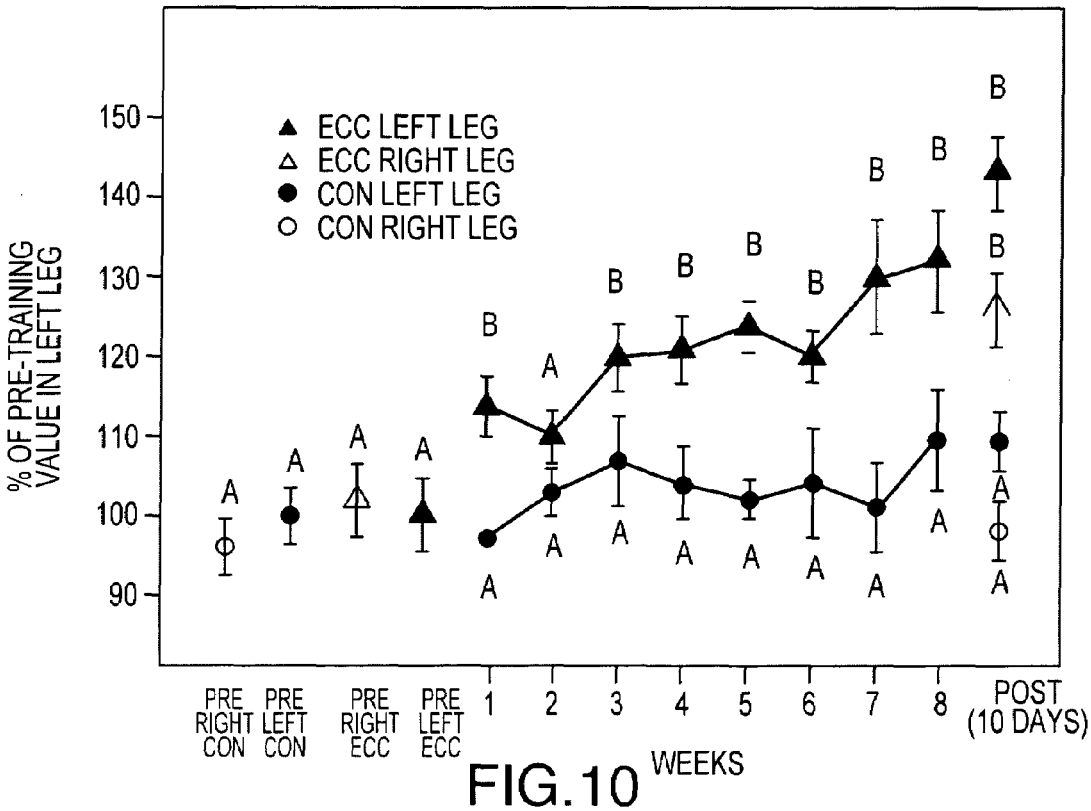
FIG. 10 is a graph comparing isometric knee extension strength changes before, during, and after an eight week training period using a traditional concentric ergometer and the eccentric ergometer shown in FIGS. 1–2.
Figure 11:
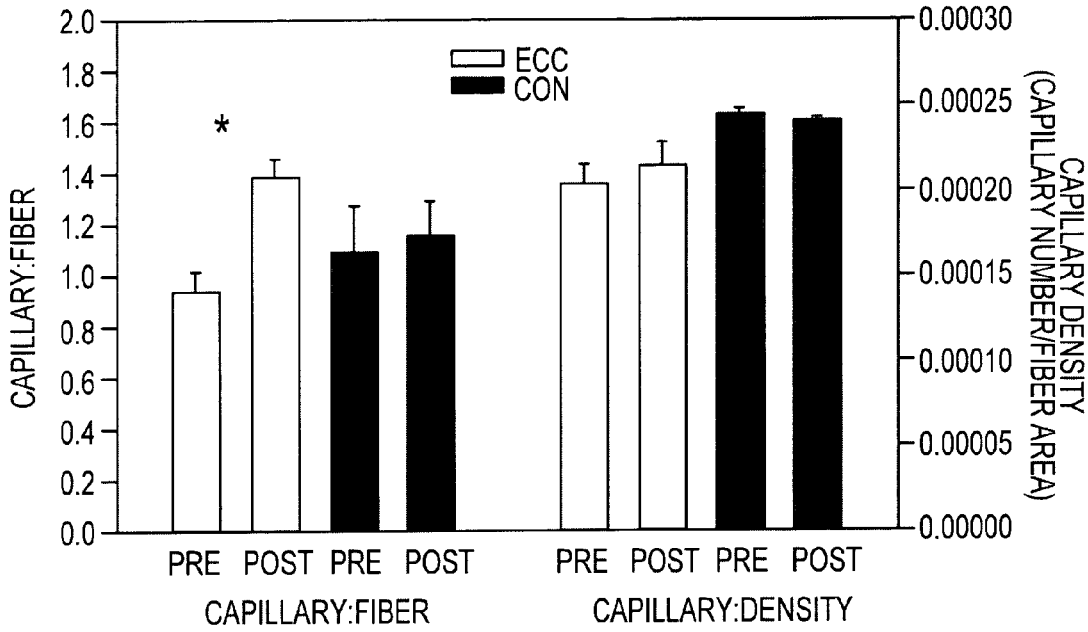
FIG. 11 is a bar graph comparing capillary fiber cross-sectional areas both before and after an eight week training period using a traditional concentric ergometer and the eccentric ergometer shown in FIGS. 1–2.
Figure 12:
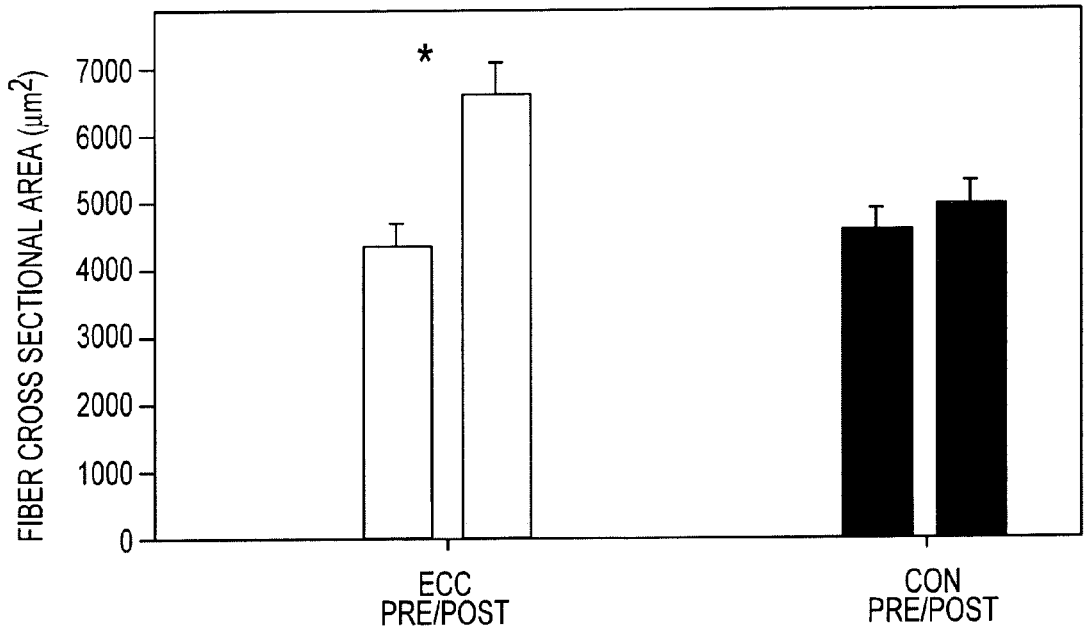
FIG. 12 is a bar graph comparing capillary-to-fiber ratio and capillary density both before and after an eight week training period using a traditional concentric ergometer and the eccentric ergometer shown in FIGS. 1–2.

Ecc and Con cycle ergometry training workloads increased progressively as the training exercise intensity increased over the weeks of training. Both groups exercised at the same % $HR_{peak}$, and there was no significant difference between the groups at any point during training. But, the increase in work for the Ecc group was significantly greater than the Con group as shown in FIG. 8. Perceived exertion for the body was not significantly different between the Ecc and Con groups but perceived exertion of the legs was significantly greater in the Ecc group over the 8 week training period as shown in FIG. 9. Isometric strength improvements for the left leg were significantly greater every week (except week 2) for the Ecc group as shown in FIG. 10 but no changes in strength were noted in the Con group at any time. There was also a significant right leg/left leg X pre/posttraining interaction for the Ecc group but none for the Con group. Further, as shown in FIG. 11, Ecc fiber area was significantly larger posttraining while no fiber area change was noted for the Con group. Finally, Ecc capillary-to-fiber ratio significantly increased posttraining (47%), paralleling the increase noted in fiber cross-sectional area, whereas the Con group did not (See FIG. 12).

This study demonstrates that if the training exercise intensity is ramped up and equalized for both groups over the first 5 weeks and then maintained for three additional weeks, then large differences in muscle force production, measured as total work, result comparing the significant increases in isometric strength and fiber size, neither of which occurred in the Con group.

The method and apparatus of the present invention enable an Ecc skeletal muscle paradigm that can be used in clinical settings to deliver greater stress to locomotor muscles (workloads exceeding 100 W), without severely stressing the oxygen delivery capacity of the cardiovascular system. Patients with chronic heart failure and/or obstructive pulmonary disease could at least maintain their muscle mass and perhaps even experience an increase in muscle size and strength using the method and apparatus of the present invention. The method and apparatus of the present invention may also function to increase lung capacity in patients with respiratory limitations.

Figure 13:
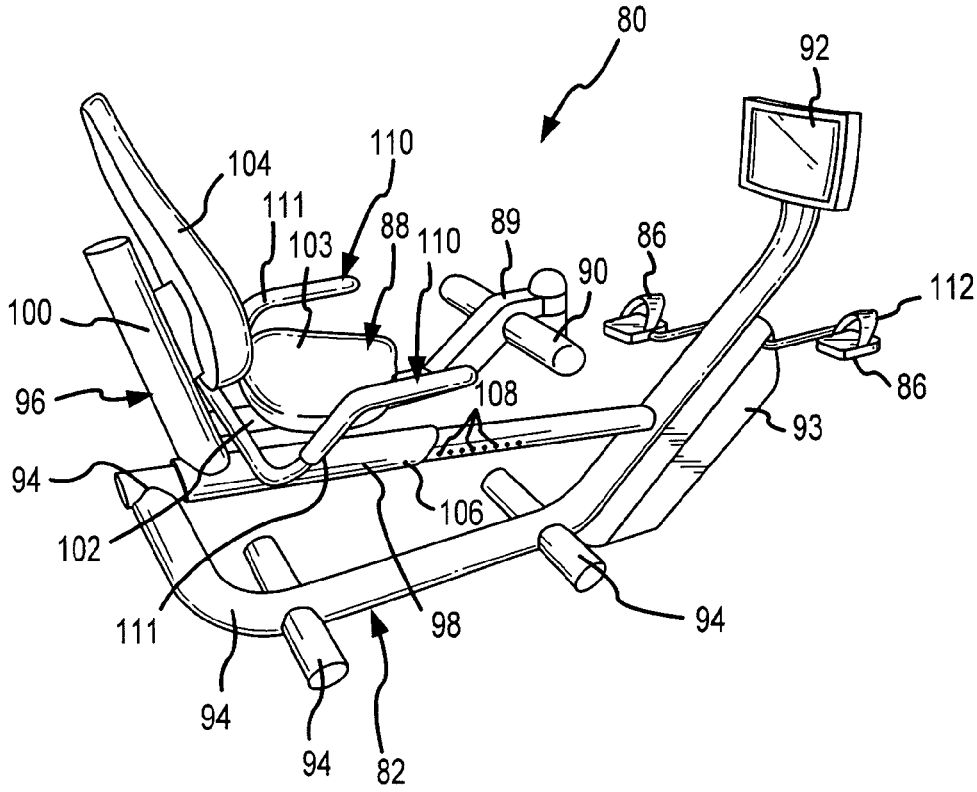
FIG. 13 is a perspective view of another embodiment of an eccentric ergometer in accordance with the present invention.

Another embodiment of an eccentric ergometer in accordance with the present invention is shown in FIG. 13. Like the embodiment of the eccentric ergometer 10 shown in FIGS. 1–2 , eccentric ergometer device 80 shown in FIG. 13 is a powered, i.e. active, recumbent apparatus that enables a user to experience eccentric loads. Device 80 includes a frame 82, a turning crank 84 (See FIG. 17) having pedals 86, a recumbent seat 88, a control panel 89, a bar member 90 for preventing a user from fully extending his knees during operation of the device, visual display device 92, and a motor and a motor controller housed within a housing 93. Frame 82 of device 80 includes a plurality of tubular members 94 which are connected to one another such that they provide adequate support for a user to operate pedals 86 while seated in recumbent seat 88. However, it will be understood by those skilled in the art that a great variety of structures and configurations may be used to comprise frame 82 as long as frame 82 is capable of supporting a user in recumbent seat 88 while the user is operating pedals 86.

Recumbent seat 88 is preferably an adjustable recumbent seat so that device 80 can be adjusted to accommodate the different leg length of various users. Further, recumbent seat 88 is securely positioned at an optimal angle of about 15 degrees with respect to turning crank 84 so that the user experiences an effective eccentric load on the user's muscles. However, it should be understood that the seat angle is directly related to the height of the pedals and therefore may vary somewhat depending upon the exact configuration of the device. In device 80, recumbent seat 88 is made adjustable by attaching it to a support 96 which includes a first tube member 98 connected to a second tube member 100, and a third tube member 102 connected to second tube member 100. The bottom 103 of recumbent seat 88 is connected to third tube member 102, and the back 104 of recumbent seat 88 is connected to second tube member 100. First tube member 98 is hollow and fits circumferentially around one of the tubular members 94 of frame 82 thereby enabling recumbent seat 88 to move forward and backward along the length of the tubular member 94 which it surrounds. First tube member 98 includes at least one aperture 106 which is in alignment with a plurality of apertures 108 contained in the tubular member 94 which first tube 98 surrounds so that recumbent seat 88 can be locked into position by inserting a locking piece through aperture 106 and one of the plurality of apertures 108 in tubular member 94.

Although an exemplary embodiment of an adjustable recumbent seat has been described, it will be understood by those in the art that a variety of structures and configurations may be used to make recumbent seat 88 adjustable with respect to frame 82 and that the structures and configurations used will depend upon the structures and configurations used for frame 82. Recumbent seat 88 may also include a pair of arms 110. Although arms 110 in device 80 are connected to third tube member 102, the present invention contemplates a variety of configurations and connection points for arms 110 of recumbent seat 88 depending upon the structure and configuration of support 96. In addition, arms 110 may further comprise grip covers 111 for assisting a user in securing their grip of arms 110 during operation of the device.

The speed controlled eccentric exercise apparatus of the present invention may include a safety element which prevents users from reaching full extension at the knees while operating the apparatus. Device 80 includes bar member 90 which is connected to third tube member 102 of support 96 by way of a fourth tube member (See FIG. 16B) to enable the adjustment of bar member 90 for accommodating a user's knees. In use, the position of bar member 90 is adjusted either forward or backward until it is positioned directly under a user's knees. Bar member 90 is positioned at a specific height in relation to the horizontal position of pedals 86 to ensure that a user's knees will remain slightly bent at all times during operation of the device thereby preventing the user from locking and injuring their knees when resisting the rotation of pedals 86. Although one embodiment of the safety element for preventing the locking of a user's knees has been described with respect to the present invention, it will be understood by those skilled in the art that other shapes and configurations may be used for the safety element as long as the safety element supports or maintains a user's knees in a bent position during operation of the device.

Visual display device 92 is connected to frame 82 and may be programmed to display a variety of data including, but not limited to, deceleration power, time elapsed, a user's heart rate, pedal revolutions per minute, intensity level, speed, and measurement of work performed.

Pedals 86 may further comprise straps 112 for securing a user's feet to pedals 86. Straps 112 prevent a user's feet from slipping off pedals 86 during operation of device 80.

Figure 14:
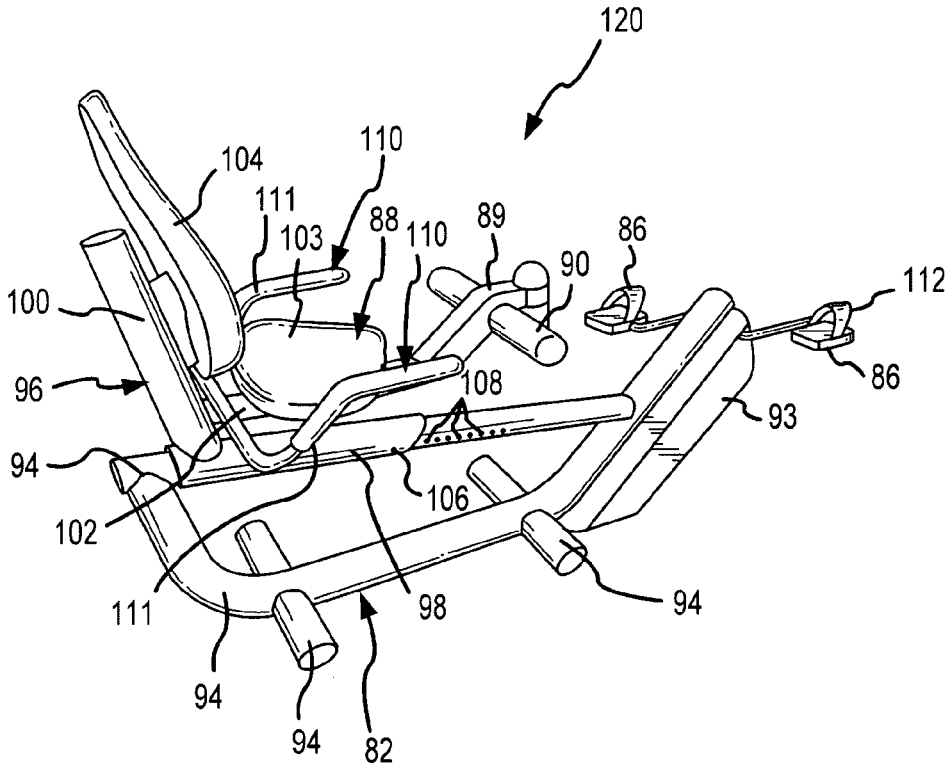
FIG. 14 is a perspective view of still another embodiment of an eccentric ergometer in accordance with the present invention.

FIG. 14 is a perspective view of still another embodiment of an eccentric ergometer in accordance with the present invention. Eccentric ergometer device 120 shown in FIG. 14 comprises all of the same elements as device 80 previously described with reference to FIG. 13 with the exception of the visual display device. In addition, frame 82 of device 120 differs in configuration from the frame of device 80 by limiting the height of frame 82 located near turning crank 84 and pedals 86 to a position just above turning crank 84 thereby presenting a more sleek device which takes up less space. It will also be understood by those skilled in the art that some or all data previously displayed on visual display device 92 of device 80 may alternatively be displayed by control panel 89.

Figure 15:
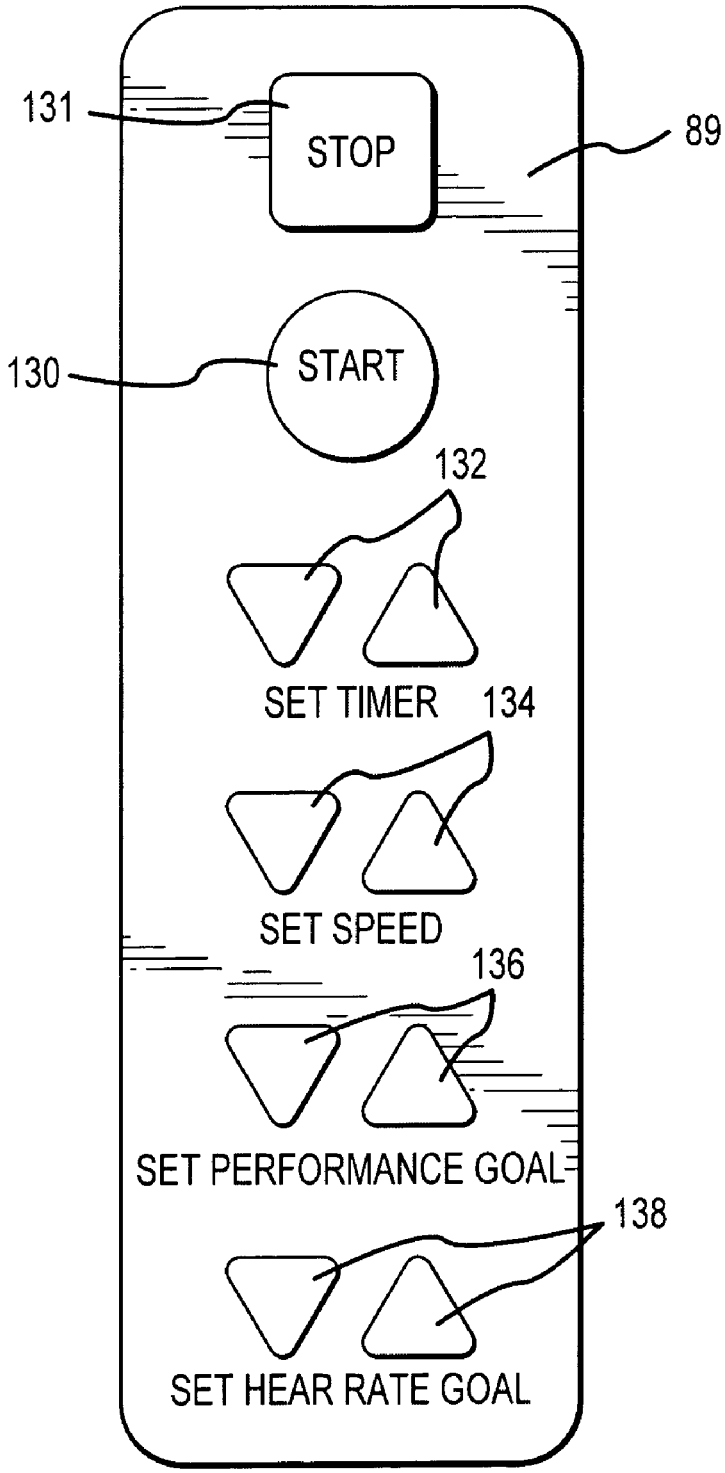
FIG. 15 is a schematic view showing an exemplary embodiment of the control panel of the eccentric ergometer shown in FIG. 14.

An enlarged schematic layout of an exemplary embodiment of control panel 89 of device 120 is shown in FIG. 15. Control panel 89 comprises one embodiment of a control panel that can be used with device 120 and includes a selection indicator 130 for starting device 120, a selection indicator 131 for stopping device 120, selection indicators 132 for increasing and decreasing a time setting, selection indicators 134 for increasing and decreasing a speed setting, selection indicators 136 for increasing and decreasing a performance goal setting, and selection indicators 138 for increasing and decreasing heart rate goal setting. Selection indicators 132, 134, 136 and 138 may alternatively comprise one up/down arrow set having one mode button or dial selection indicators 132, 134, 136 and 138 may function to adjust a numerical value and/or step through pre-set workout programs. Values for selection indicators 132, 134, 136 and 138 may be displayed graphically and/or numerically on a monitor. Control panel 89 is connected via cables (not shown) to a motor controller which is in turn connected to a motor (See FIGS. 16C and 17).

Figure 16B:
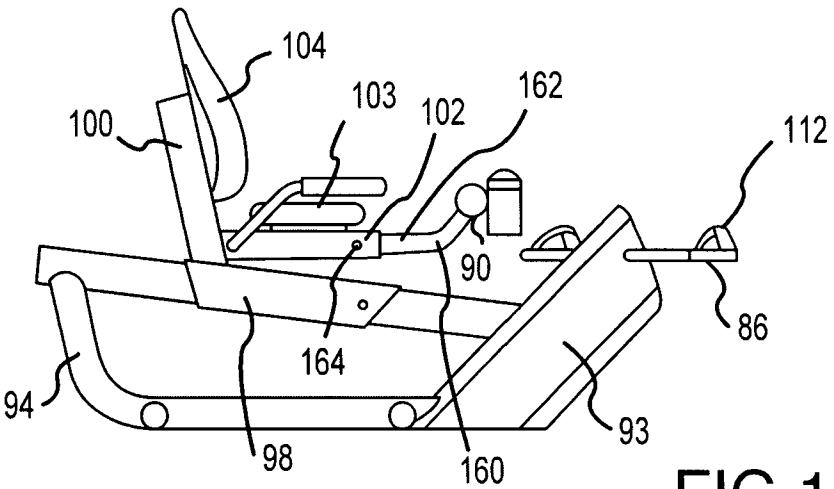
FIG. 16B is a side elevational view of the eccentric ergometer shown in FIG.>14.
Figure 16C:
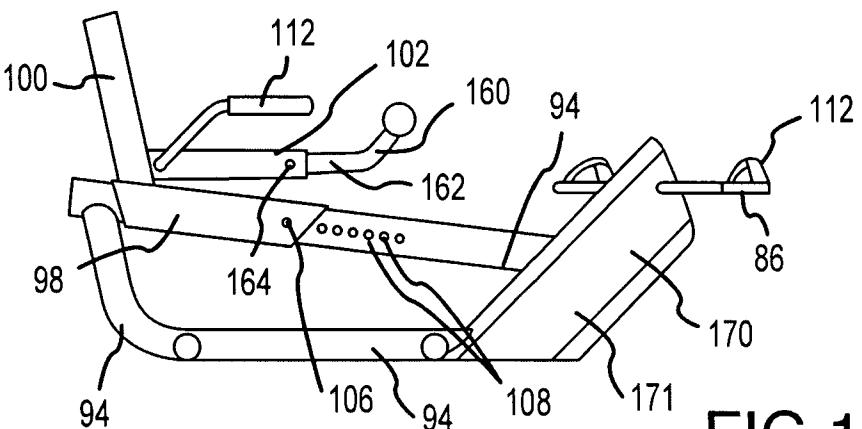
FIG. 16C is a side elevational view of the eccentric ergometer in FIG. 14 shown without the recumbent seat, motor housing, control panel and grip members.
Figure 16A:
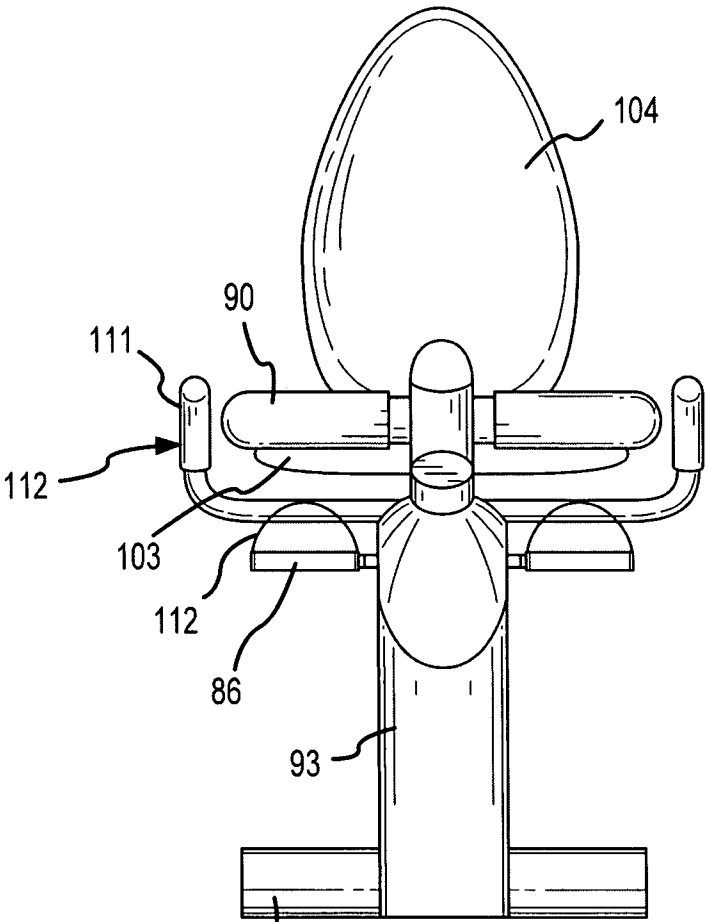
FIG. 16A is a front elevational view of the eccentric ergometer shown in FIG. 14.

Turning now to FIGS. 16A–16C, front and side elevational views of device 120 depicted in FIG. 14 are shown. FIG. 16A is a front elevational view of device 120 shown in FIG. 14 which clearly shows housing 93 which houses a motor and motor controller. FIG. 16B is a side elevational view of device 120 shown in FIG. 14. As shown in FIG. 16B, bottom 103 of recumbent seat 88 is attached to third tube member 102 of support 96. Bar member 90 is attached to third tube member 102 via a fourth tube member 160 having a plurality of apertures 162 wherein the fourth tube member 160 is partially contained within, and slidably engaged with, third tube member 102. Third tube member 102 includes at least one aperture 164 in alignment with the plurality of apertures 162 in fourth tube member 160 to enable forward and backward adjustment of bar member 90 in order to accommodate the varying sizes of users. In order to secure bar member 90 in place, aperture 164 is aligned with one of the plurality of apertures 164, and a locking piece such as a pin member or the like is inserted through both apertures 164 and 162.

Figure 17:
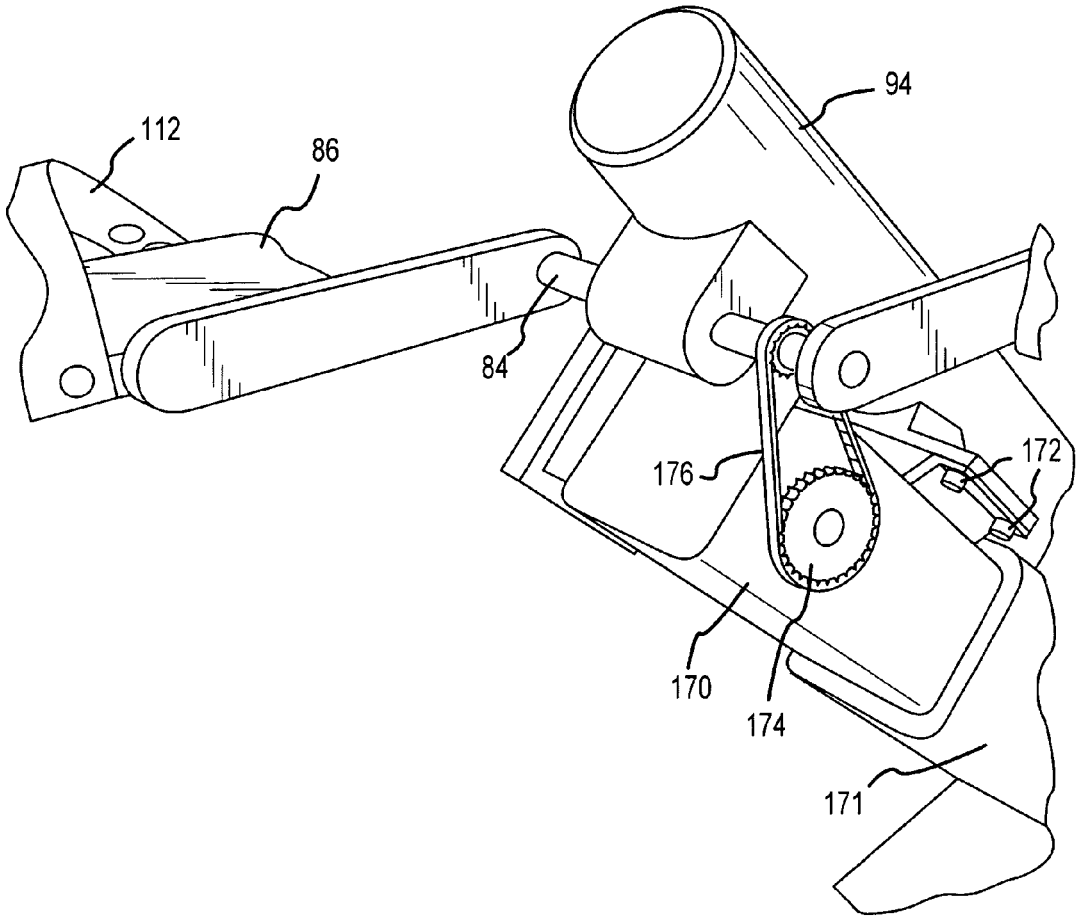
FIG. 17 is an enlarged perspective view of the drive motor and turning crank of the eccentric ergometer shown in FIG. 16C.

An enlarged perspective view of the device motor and turning crank of the device depicted in FIG. 16C is shown in FIG. 17. Motor 170 is attached to frame 94 via bolts 172 motor 170 includes a chain sprocket 174 which is connected to turning crank 84 by a belt 176 to enable rotation of turning crank 84 by motor 170. In use, a user sets a predetermined speed via selection indicators 134 on control panel 89 which sends a signal to a central processing unit (CPU) (contained in electronics module 171) which in turn sends a signal to a motor controller (contained in electronics module 171) which causes motor 170 to turn crank 84 at a predetermined speed Foot pedal 86 includes a wired sensor integrated into the pedal that senses speed and in turn relays the speed data to the CPU. The CPU then sends signals to the motor controller to adjust the speed of motor 170 accordingly in order to maintain the predetermined speed set by the user.

Frame 82 is preferably comprised of a steel tubing or a similar durable material that is resistant to damage and wear. Alternating current or direct current type motors may be used for motor 170.

Figure 18:
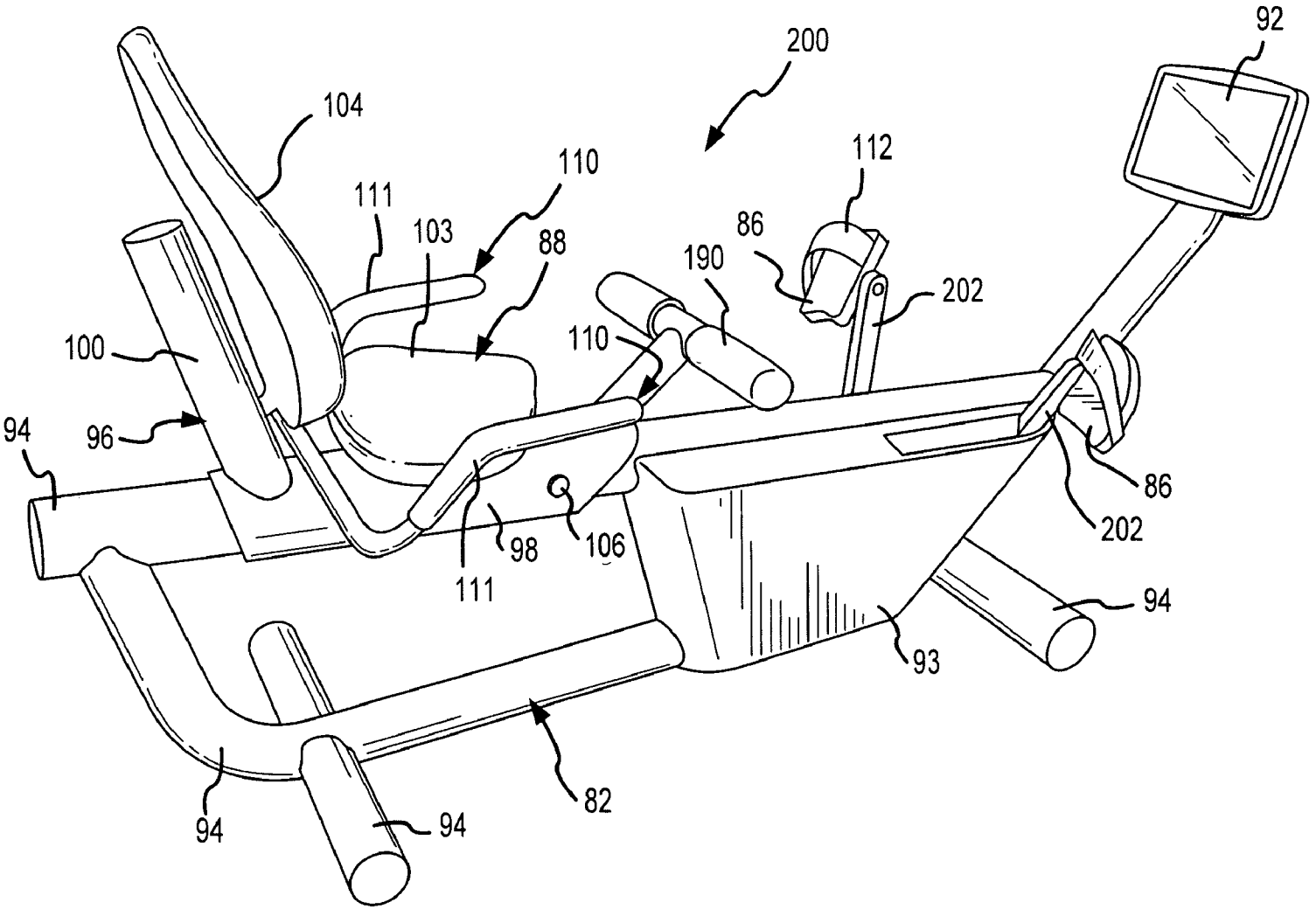
FIG. 18 is a perspective view of yet another embodiment of an eccentric ergometer in accordance with the present invention.

FIG. 18 shows a perspective view of yet another embodiment of an eccentric ergometer 200 in accordance with the present invention. Eccentric ergometer 200 includes all of the features of eccentric ergometers 80 and 120 described with reference to FIGS. 13–14 and FIG. 17 with the exception of the drive mechanism used, namely turning crank 84 and its related elements. Instead, eccentric ergometer 200 includes bar presses 202 which reciprocate in forward and backward directions. Motor housing 93 is also positioned differently than the motor housing shown in with reference to eccentric ergometers 80 and 120 shown in FIGS. 13 and 14 and it will be understood by those skilled in the art that motor housing 93 and the other components is houses, namely the drive mechanism and its related parts, the CPU, and the motor controller, may be located at different positions along the frame.

Figure 19:
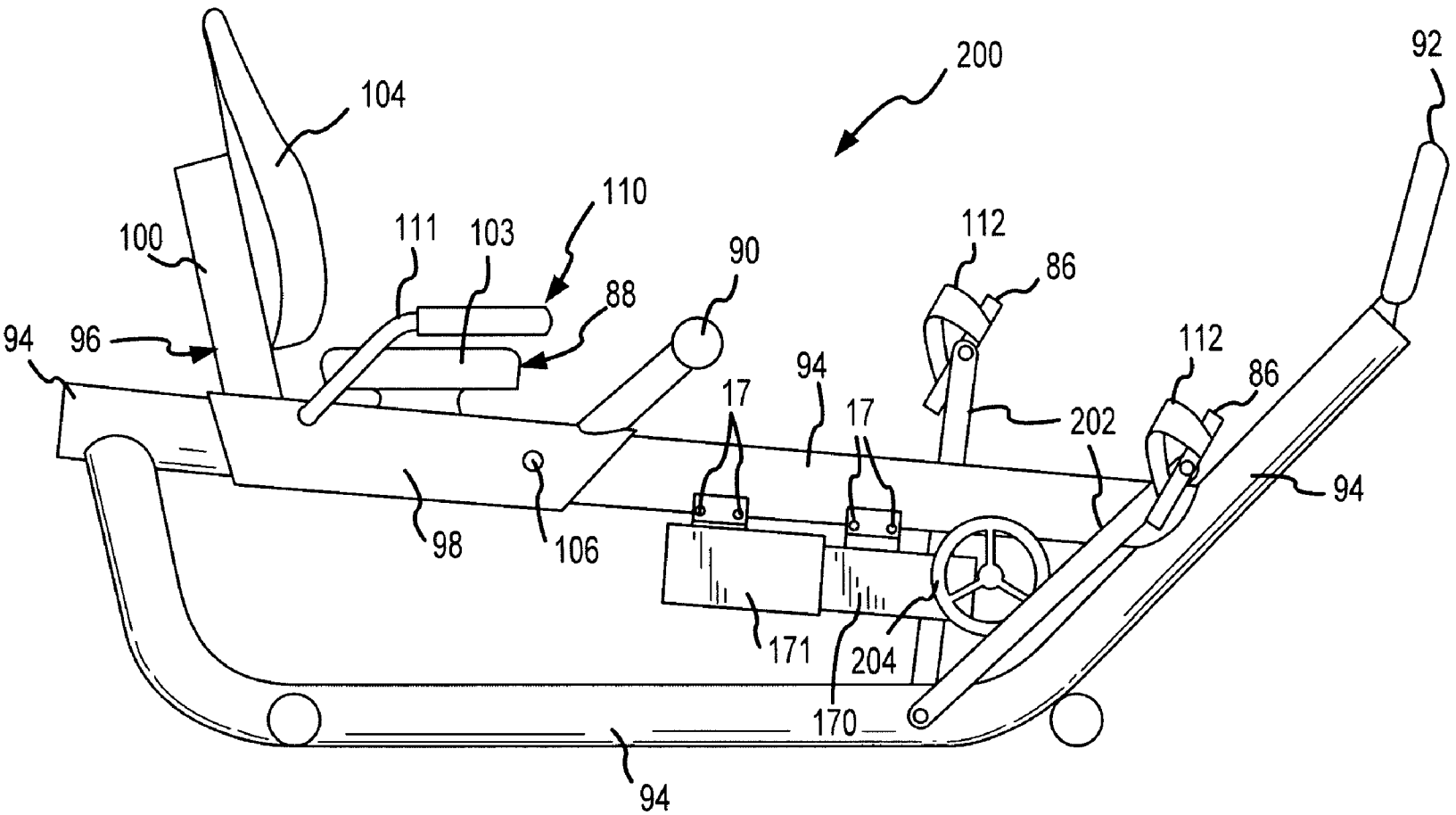
FIG. 19 is a side elevational view of the eccentric ergometer in FIG. 18 shown without the motor housing.
Figure 20:
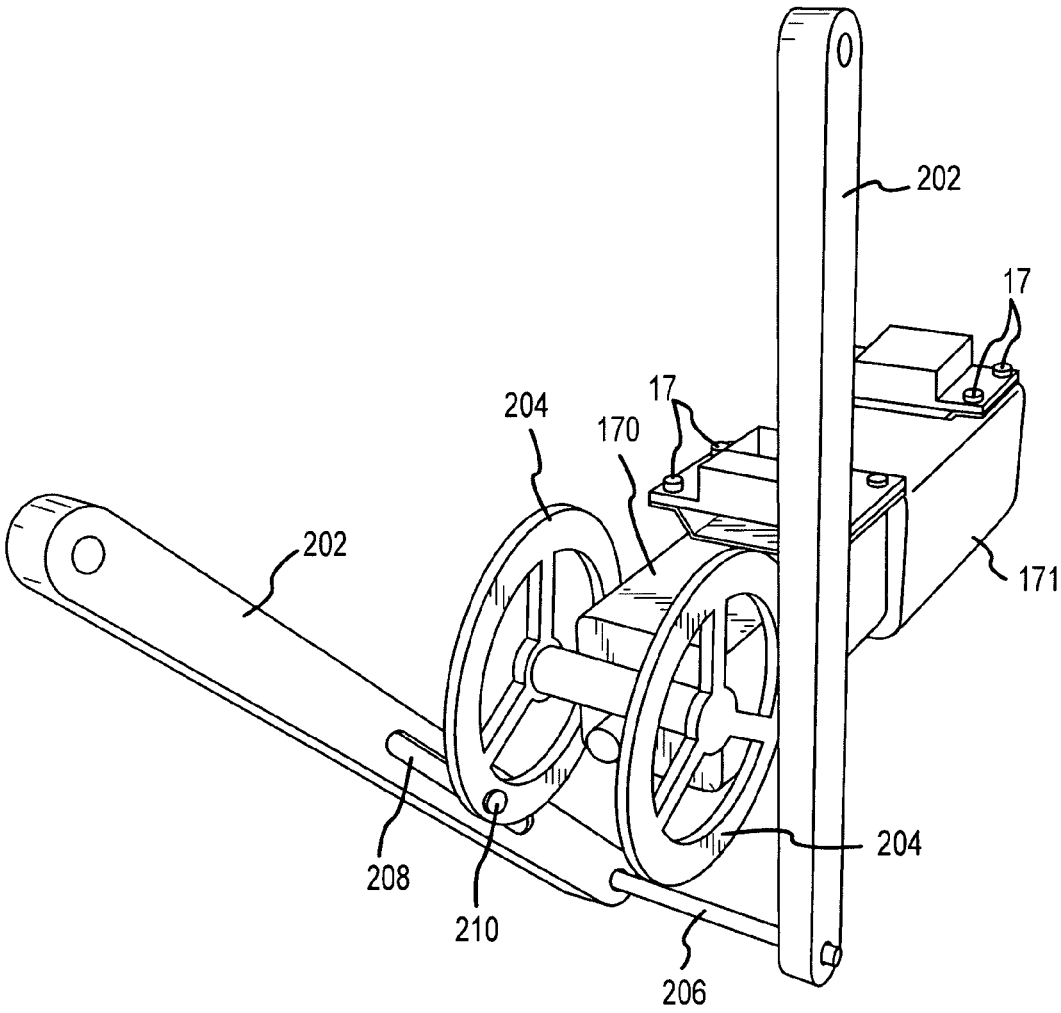
FIG. 20 is an enlarged perspective view of the drive motor and reciprocating bars of the eccentric ergometer shown in FIG. 19.

FIG. 19 is a side elevational view of eccentric ergometer 200 shown with motor housing 93 removed Motor 170 turns spindle 204, which is in turn connected to bar presses 202, in forward and backward directions. An enlarged perspective view of the drive mechanism for eccentric ergometer 200 is shown in FIG. 20. As previously stated, motor 170 is connected to spindle 204 and turns spindle 204 in forward and backward directions. Spindle 204 is connected to bar presses 202 via a peg 210, bolt, or the like, which resides in, and traverses across, slot 208 contained in bar press 202. A peg and slot type mechanism is used on each side of spindle 204 to move bar presses 202 in reciprocating forward and backward directions. As shown in FIGS. 18 and 19, pedals 86 or other engagement means are positioned on bar presses 202 to enable a user to resist the reciprocal movement of bar presses 202 driven by motor 170. No sensors are needed to determine changes in speed. Instead, a straightforward measurement of pressure on the pedals can be obtained.

As described above, the embodiment shown in FIGS. 18–20 uses an electric motor to actuate a linkage that causes pedals to reciprocate in a front-to-rear motion. This method of pedal actuation for an eccentric exercise trainer offers several advantages. First, the pedals move on either a linear path or on a large-radius arc thereby providing a path that is naturally and easily followed by a user. Second, the user can maintain maximum resistance through the entire pedal stroke for both legs in each direction. Third, eccentric exercise is applied to the muscles throughout their full range of contraction/extension. Fourth, the pedals do not spin freely thereby reducing the likelihood of injury to the user. Fifth, by creating a nearly linear path for leg motion, the mechanism enables a machine design that reduces the possibility of a user having their knees lock thereby further reducing the chances of injury to the user. Sixth, the mechanism supports a wide range of pedal speeds and the movement of the pedals on a linear path enable easy measurement and communication of resistance data.

Figure 21:
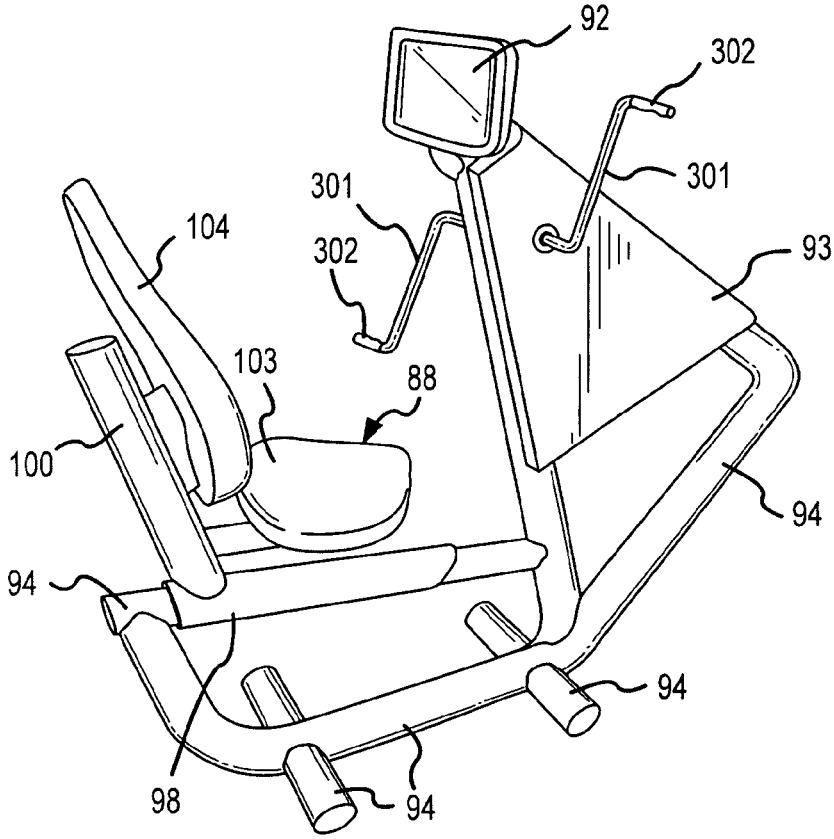
FIG. 21 is a perspective view of yet another embodiment of an eccentric ergometer in accordance with the present invention which may be used for performing upper body eccentric exercise.
Figure 22:
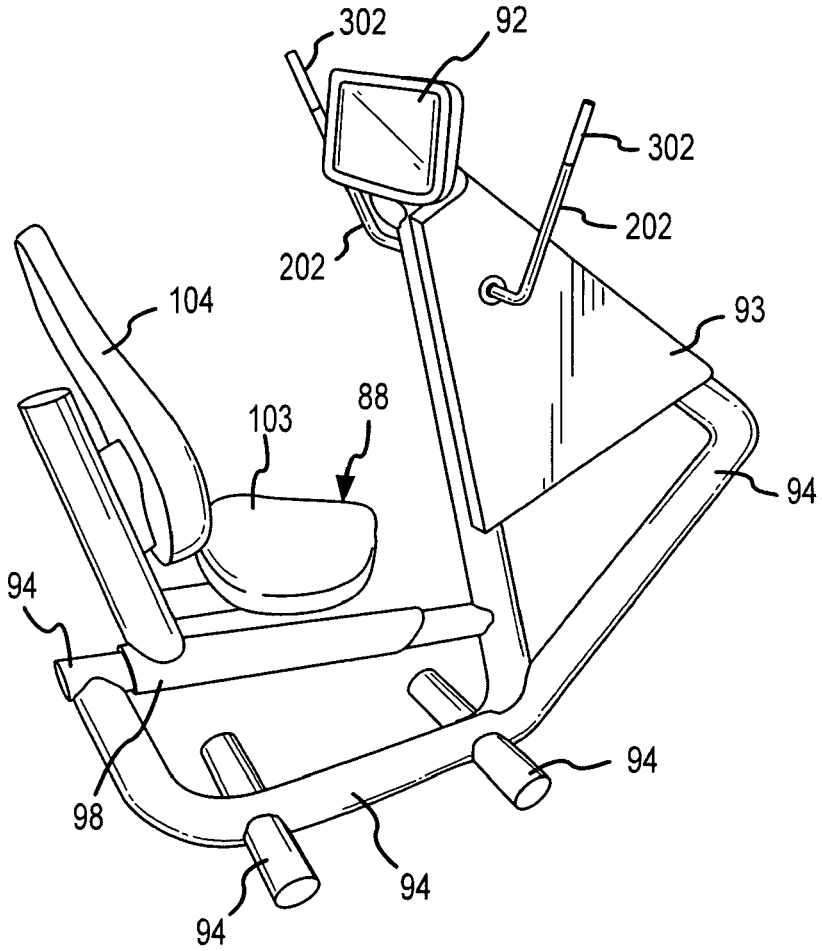
FIG. 22 is a perspective view of still another embodiment of an eccentric ergometer in accordance with the present invention which may be used for performing upper body eccentric exercise.

FIGS. 21 and 22 show perspective views of two different embodiments of eccentric ergometers for exercising a user's upper body. FIG. 21 depicts an upper body eccentric ergometer apparatus which utilizes a turn crank for engaging a user's muscles for exercise while FIG. 22 depicts an upper body eccentric ergometer device which utilizes a pair of reciprocating bar presses for engaging a user's muscles for exercise. FIGS. 21 and 22 exemplify eccentric arm ergometers that are designed to produce negative work in the arm musculature however, these apparatus also function to load the abdominal, back and trunk muscles as well. Arm strengthening at very low energy costs can benefit those who use upper arm extremities in sport or locomotion such as wheelchair propulsion. In addition, the eccentric loads to the muscle with these types of devices can exceed what is typically produced on machines or with free weights in a gym. In rehabilitation settings, these types of devices can help those patients with impaired abilities to breathe by improving their respiratory skeletal muscle status without stressing their impaired pulmonary system Such devices described herein may also be used to assist in preventing or rehabilitating patients with back pain.

Further, it will be understood by those skilled in the art that various other configurations of the apparatus may be designed in order to effectively exercise other muscles of a user's body in an eccentric manner. For example, the same elements which comprise the previously described eccentric ergometers may be repositioned and/or configured in a different way in order to effectively exercise the various muscles of the back in an eccentric manner.

The foregoing description is of exemplary embodiments of the subject invention it will be appreciated that the foregoing description is not intended to be limiting; rather, the exemplary embodiments set forth herein merely set forth some exemplary applications of the subject invention. It will be appreciated that various changes, deletions, and additions may be made to the components and steps discussed herein without departing from the scope of the invention as set forth in the appended claims.

The invention claimed is:

1. An apparatus for performing speed controlled eccentric exercise comprising:

a frame;

at least one support attached to said frame for supporting a user's body;

at least one engagement member comprising a bar press attached to said frame for engaging at least one part of the user's body, said engagement member being moveable in opposite directions;

means for supplying power to said engagement member such that said engagement member is capable of exerting a force in a first direction at a predetermined speed;

a drive mechanism attached to said engagement member to move said engagement member in said first direction wherein the drive mechanism is powerd by said power supply means and comprises a reciprocating wheel which moves said bar press in alternating forward and backward directions, means for detecting a change in said predetermined speed after the user supplies a force to said engagement member in a direction opposite said first direction; and means for adjusting output of the power supply means to maintain said predetermined speed.

2. The apparatus of claim 1 wherein said at least one support comprises a seat.

3. The apparatus of claim 2 wherein said seat comprises a recumbent seat.

4. The apparatus of claim 3 wherein said recumbent seat is adjustable.

5. The apparatus of claim 4 further comprising a support structure for the recumbent seat wherein the recumbent seat is attached to the support structure and the support structure is attached to the frame.

6. The apparatus of claim 4 wherein said recumbent seat is positioned at an angle of about 15 degrees relative to a furthermost position from the user of said at least one engagement means.

7. The apparatus of claim 1 wherein said at least one engagement means further comprises at least one of a pedal and a hand grip.

8. The apparatus of claim 7 further comprising at least one strap for securing a user's foot to said pedal and a user's hand to said hand grip.

9. The apparatus of claim 1 wherein said power supply means comprises a motor.

10. The apparatus of claim 1 further comprising a safety element which prevents full extension of at least one of a user's joints during operation of the apparatus.

11. The apparatus of claim 1 wherein said frame comprises a plurality of tubular shaped members.

12. The apparatus of claim 1 wherein said means for detecting a change in said predetermined speed comprises a sensor.

13. The apparatus of claim 1 wherein said means for adjusting output of said power supply means to maintain said predetermined speed comprises a central processing unit which sends signals to a motor controller.

14. The apparatus of claim 1 further comprising display means for displaying at least one of a deceleration power, a time elapsed, a user's heart rate, and at least one of a number of revolutions per minute or reciprocations per minute.

15. The apparatus of claim 1 further comprising a control panel for starting the apparatus, stopping the apparatus, and setting at least one of a timer, a speed, a performance goal, and a heart rate goal.

16. The apparatus of claim 1 for performing upper body eccentric exercise wherein said at least one engagement member comprises a pair of reciprocating bar presses having a pair of hand grips attached thereto for engaging a user's hands.

17. The apparatus of claim 1 for performing lower body eccentric exercise wherein said at least one engagement member comprises a pair of reciprocating bar presses having a pair of pedals attached thereto for engaging a user's feet.

* * * * *